US008783496B2

(12) United States Patent
Neiner et al.

(10) Patent No.: US 8,783,496 B2
(45) Date of Patent: Jul. 22, 2014

(54) DOUBLE-OPENING CAN LID

(75) Inventors: Christopher G. Neiner, Newtown, PA (US); Ancil Louis Lackey, Oklahoma City, OK (US); Robert Joseph Will, Maria Stein, OH (US); Richard Lynn Wise, Yukon, OK (US); Jason Davidson, Sidney, OH (US)

(73) Assignee: Anheuser-Busch InBev, SA, Brussels (BE)

( * ) Notice: Subject to any disclaimer, the term of this patent is extended or adjusted under 35 U.S.C. 154(b) by 0 days.

(21) Appl. No.: 13/598,318

(22) Filed: Aug. 29, 2012

(65) Prior Publication Data

US 2013/0264344 A1 Oct. 10, 2013

Related U.S. Application Data

(60) Provisional application No. 61/620,027, filed on Apr. 4, 2012.

(51) Int. Cl.
*B65D 17/34* (2006.01)

(52) U.S. Cl.
USPC ..... 220/272; 220/265; 220/269; 220/270; 220/367.1; 220/369; 220/660; 220/662; 220/669; 220/906; 222/541; 222/545; 215/381; 215/382; 215/383; 215/384; 215/385

(58) Field of Classification Search
USPC ..... 220/265, 269, 270, 272, 367.1, 379, 220/660, 662, 669, 906; 222/541, 545; 215/381, 382, 383, 384, 385
See application file for complete search history.

(56) References Cited

U.S. PATENT DOCUMENTS

| | | | | |
|---|---|---|---|---|
| 3,420,398 | A | 1/1969 | Chun | |
| 3,441,169 | A | 4/1969 | Dunn et al. | |
| 4,136,797 | A | 1/1979 | Potts | |
| 4,865,215 | A | 9/1989 | Wells | |
| 4,872,597 | A | 10/1989 | Hanafusa | |
| 4,994,117 | A * | 2/1991 | Fehder | 436/133 |
| 5,011,037 | A | 4/1991 | Moen et al. | |
| 5,397,014 | A | 3/1995 | Aydt | |
| 5,695,085 | A | 12/1997 | Hadener | |
| 6,112,932 | A | 9/2000 | Holdren | |
| 6,131,763 | A | 10/2000 | Stanish et al. | |

(Continued)

FOREIGN PATENT DOCUMENTS

| | | | | |
|---|---|---|---|---|
| CA | 2280461 | A1 | 2/2001 | |
| JP | 10245032 | * | 9/1998 | B65D 17/32 |
| NL | 1023297 | C1 | 11/2004 | |
| WO | WO-2008023983 | A1 | 2/2008 | |

*Primary Examiner* — Fenn Mathew
*Assistant Examiner* — Elizabeth Volz
(74) *Attorney, Agent, or Firm* — Gardere Wynne Sewell LLP

(57) ABSTRACT

An improved beverage container of the type having a lid, a pour panel defined in the lid by a pour score and a vent panel defined in the lid by a vent score. A tab pivotally is mounted to the lid, wherein lifting the tab about a pivot in a lifting direction fractures the pour score and opens the pour panel. A secondary tab is carried by the tab, and is released into contact with the vent panel by lifting the tab to fracture the pour score, wherein pressing the tab in a direction generally opposite the lifting direction causes the secondary tab to fracture the vent score and open the vent panel. At least one anti-rotation member is disposed between the tab and the lid to prevent the tab from rotating about the rivet.

5 Claims, 13 Drawing Sheets

(56) References Cited

U.S. PATENT DOCUMENTS

| | | | |
|---|---|---|---|
| 6,202,880 | B1 | 3/2001 | Strube et al. |
| 6,981,608 | B2 | 1/2006 | Battmer |
| 8,245,866 | B2 | 8/2012 | Gibson et al. |
| 2003/0189045 | A1 | 10/2003 | Hwang |
| 2005/0173437 | A1 | 8/2005 | Hwang |
| 2011/0108552 | A1 | 5/2011 | Tamarit Rios |

* cited by examiner

FIG. 9A
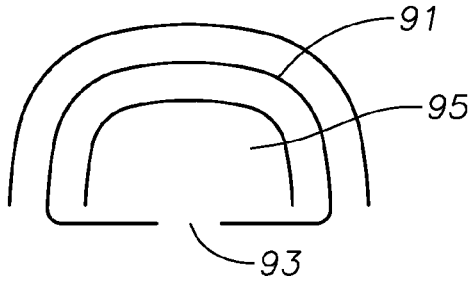
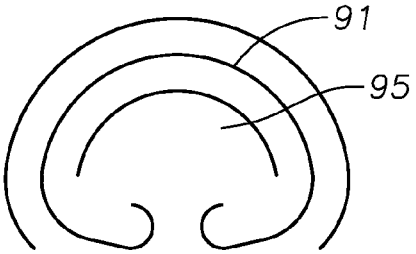
FIG. 9B
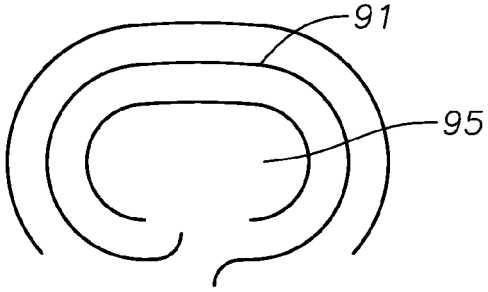
FIG. 9C
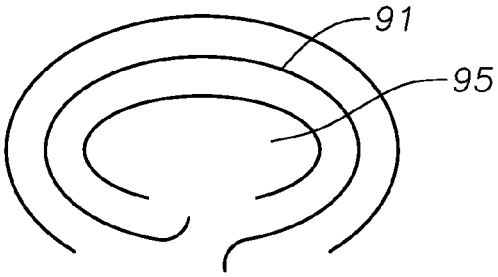
FIG. 9D
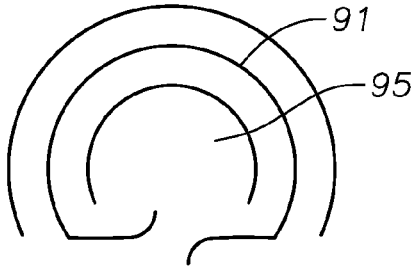
FIG. 9E
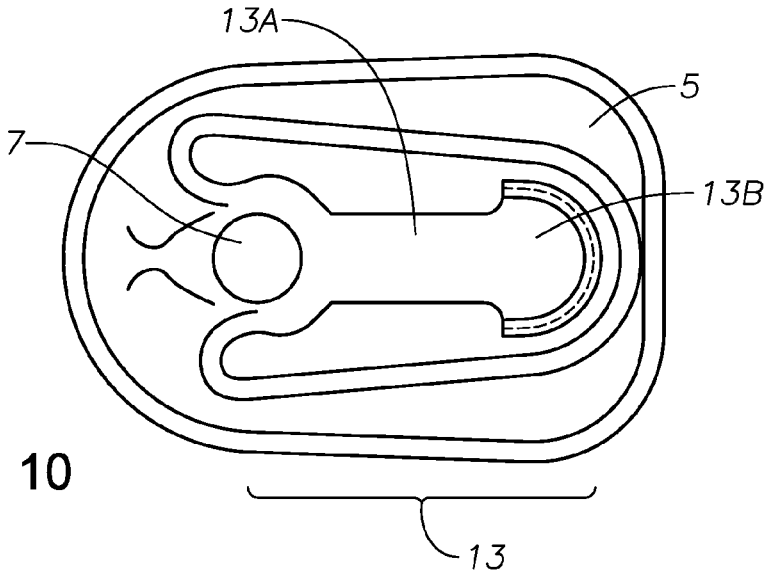
FIG. 10

DOUBLE-OPENING CAN LID

CROSS-REFERENCE TO RELATED APPLICATION

This application claims priority to provisional application 61/620,027, filed Apr. 4, 2012, which is incorporated herein by reference for all purposes.

This application is related to U.S. patent application Ser. No. 13/000,718 (the "Tamarit application"). This application discloses inventions related to the invention of the Tamarit application and improvements to the invention disclosed therein.

FIELD OF THE INVENTION

The present invention relates to improvements in a double-opening system for beverage cans. More particularly, it relates to systems for opening two openings in the lid of a beverage container or can: a primary or pour opening for the liquid and a secondary vent opening to allow air into the can while liquid is flowing from the primary opening.

BACKGROUND OF THE INVENTION

Beverage containers or cans generally have a lid having a score line or lines defining a tear panel which is opened with a tab, a rivet for fastening a tab which opens the lid by pushing in the tear panel when the back of the tab is raised and thereby the primary opening of the can is created.

The primary or pour opening or tear panel in many known designs, in addition to being the exit for the liquid in the can, is also the entrance for air to replace the exiting liquid. This dual use of the primary opening interferes with smooth pouring of the liquid contents. Accordingly, there have been many attempts, mostly unsuccessful, to provide a second, vent opening or tear panel and a convenient means or apparatus for opening both the pour and vent tear panels.

U.S. Patent Publication No. 2011/0108552 to Tamarit Rios discloses a method and apparatus for opening both a pour opening and a vent opening on a beverage can using a single pull tab. The Tamarit Rios invention may be improved upon, particularly as concerns design for manufacture and other refinements and optimizations.

SUMMARY OF THE INVENTION

It is a general object of the present invention to provide an improved beverage container of the general type disclosed in U.S. Patent Publication No. 2011/0108552. This and other objects of the present invention are achieved by providing an improved beverage container of the type having a lid, a pour panel defined in the lid by a pour score and a vent panel defined in the lid by a vent score. A primary tab is pivotally mounted to the lid, wherein lifting the primary tab about a pivot in a lifting direction fractures the pour score and opens the pour panel. An intermediate or secondary tab is carried by the primary tab, and is released into contact with the vent panel by lifting the primary tab to fracture the pour score, wherein pressing the tab in a direction generally opposite the lifting direction causes the secondary tab to fracture the vent score and open the vent panel. At least one anti-rotation member is disposed between the primary tab and the lid to prevent the tab from rotating about the rivet.

According to a preferred embodiment of the present invention, the primary tab is secured to the lid by a rivet extending through an aperture in the tab and the anti-rotation member is at least one scallop in the aperture, wherein the aperture is not round.

According to a preferred embodiment of the present invention, the anti-rotation member comprises at least one protrusion in either the lid or the primary tab, wherein engagement between the protrusion and an indentation or aperture prevent the primary tab from rotating relative to the lid.

According to a preferred embodiment of the present invention, the secondary tab is secured against contact with the lid by a shelf carried by the primary tab, wherein lifting of the primary tab causes the secondary tab to disengage from the shelf and contact the vent panel.

Other objects, features, and advantages of the present invention will become apparent with reference to the detailed description, which follows.

BRIEF DESCRIPTION OF THE DRAWINGS

FIGS. 9A through 9E are plan views of vent panels and scores according to the present invention.

FIG. 10 is a plan view of a tab according to the present invention.

DETAILED DESCRIPTION OF THE INVENTION

This application focuses in turn on a variety of aspects of the tab and lid that form a combination to open two openings (pour or primary and vent) in the lid of a beverage can. The basic operational principal is disclosed in U.S. Patent Publication No. 2011/0108552 to Tamarit Rios, which is incorporated herein by reference.

Figure 1:
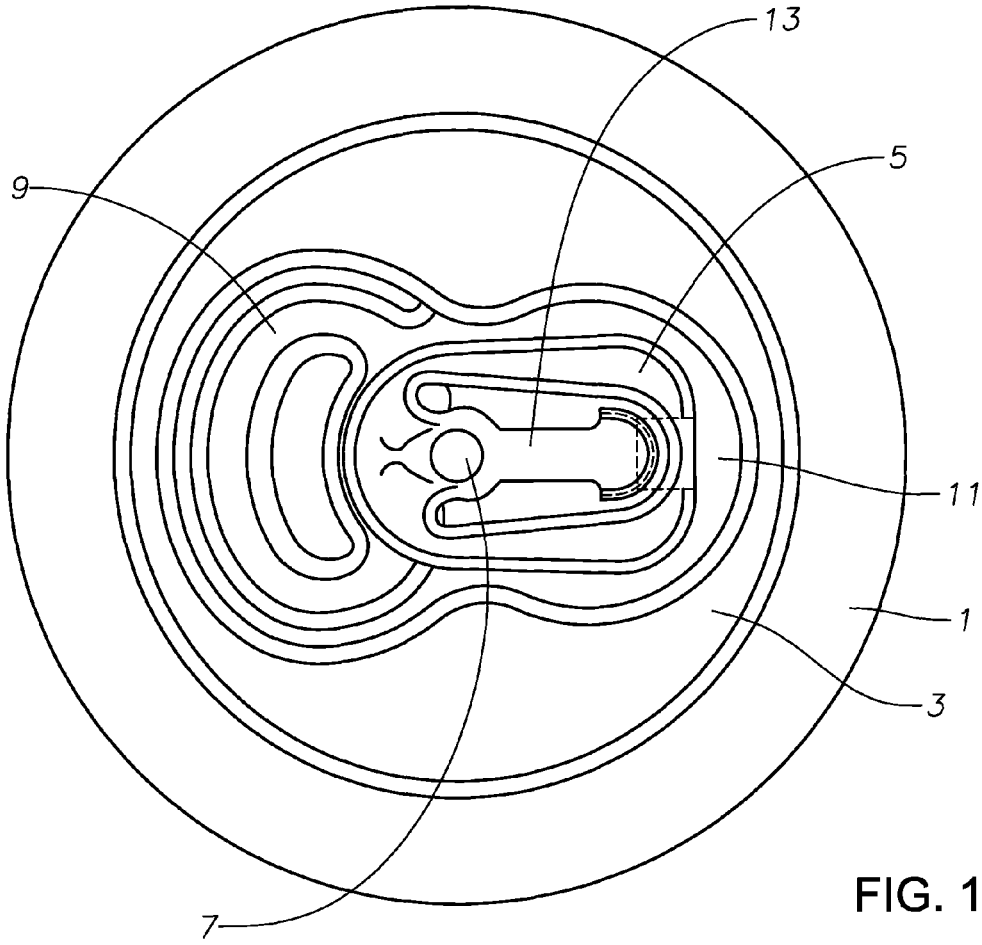
FIG. 1 is a plan view of an end of a beverage container according to the present invention having a lid and a tab for opening various panels in the lid.

FIG. 1 shows a can body 1 having a lid 3 with a tab 5 mounted thereon by a single rivet 7. Also shown in outline are the score lines for a pour opening 9 and a vent opening 11. Tab 5 operates conventionally to open pour opening 9, but also includes a secondary, vent, or intermediate tab 13 that releases from primary tab 5 during operation and becomes available to open vent opening 11. By pressing on primary tab 5 in a direction opposite that used to lift tab 5, secondary tab 13 presses on vent panel 11 to open the vent opening. The user may apply finger pressure directly to secondary tab 13, either alone or in conjunction with pressure from the primary tab 5, to fracture the vent score and open vent panel 11. The lid 3 and tab 5 of FIG. 1 are exemplary for the basic elements referred to throughout the application. "Tab" refers to the primary or main tab 5, while "intermediate" or "secondary tab" refers to the tab 13 carried by primary tab 5 and released to fracture the vent score and open the vent opening.

As can be seen, secondary tab 13 has tab strap (13A in FIG. 10) with a fixed end carried by and formed of the same material as primary tab 5 and a free end terminating in a secondary tab head (13B in FIG. 10). The end of primary tab 5 proximal to secondary tab head 13B is referred to as the back of the tab and is the portion lifted to fracture the pour panel vent score and open pour panel 9. The opposite end of primary tab 5, is referred to as the front of the tab.

Figure 2:
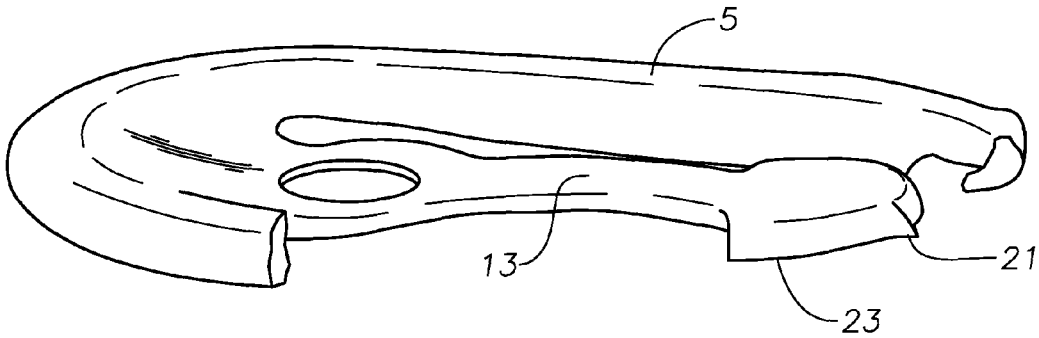
FIG. 2 is a perspective view of a tab according to the present invention.

Referring now to FIG. 2, a contactor 21 for contacting the vent score of the vent opening tear panel 11 is illustrated. It is referred to as a "shark tooth." The shark tooth 21 contactor is generally triangular with its apex pointing downward. It is centrally located along the central longitudinal axis of tab 5 and secondary tab 13 and it is formed of the material of secondary tab 13 that is bent or turned downwardly. Contactor 21 generates a point contact between a secondary tab 13 (the tab that opens the vent score) and the vent score (the scoring in the lid panel that defines the vent tear panel 11). The benefit of the point contact is that it concentrates the all the forces applied to the vent score at a single point. When secondary tab 13 is pushed against the vent score all the force is concentrated at the point of contactor 21, which improves the opening (fracturing) performance of the vent score. Without contactor 21, the forces are spread across the contact area of the secondary tab 13, which makes it more difficult to open (fracture) the vent score.

Figure 3:
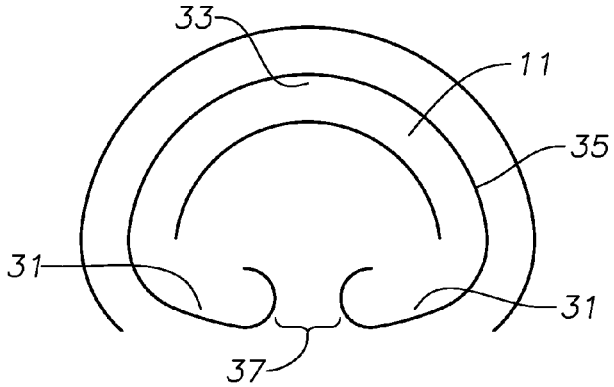
FIG. 3 is a plan view of a vent panel and score in a can lid according to the present invention.

A secondary tab skirt 23 assists in pushing vent panel 11 down into the lid 3 after the vent score is fractured, as shown in FIG. 3. Skirt 23 is located at the periphery of the head of secondary tab 13 and makes contact with vent panel 11 at points 31 after the shark tooth contactor 21 has contacted panel 11 at point 33 and forces the vent score to fracture and follow along the score line 35 (score path). Once intermediate tab skirt 23 contacts vent panel 11, it assists in bending vent panel 11 downwardly about hinge 37 into lid 3 and generates a larger gap between vent score panel 11 and lid 3. The longer the length of skirt 23, the greater the distance or degree vent panel 11 is pushed into container 1. Skirt lengths of 0.042 inch, 0.047 inch, 0.052 inch and 0.062 inch are preferred.

Figure 4:
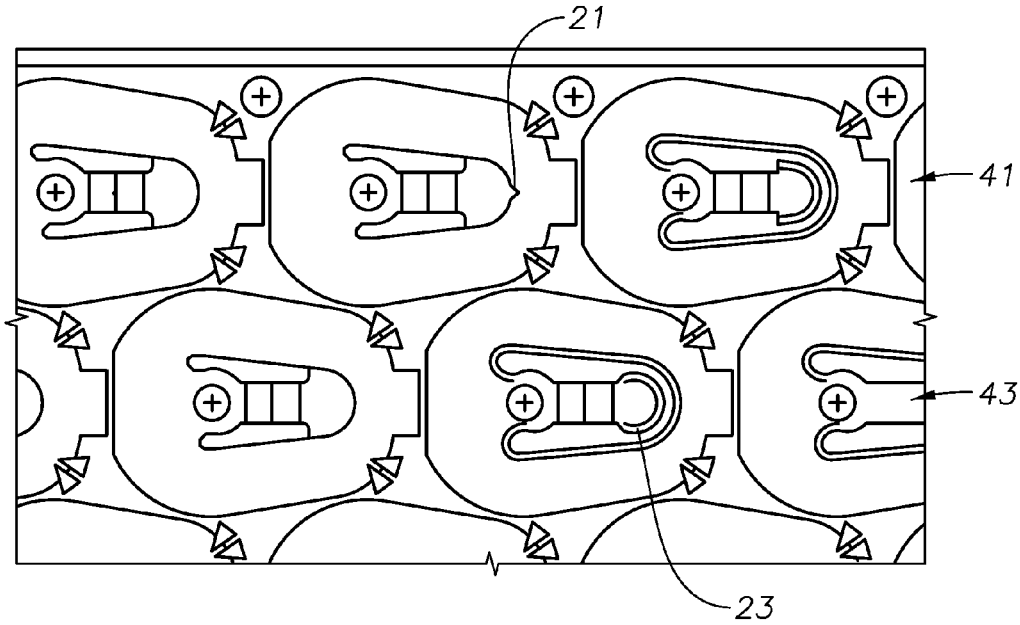
FIG. 4 is a view of tabs according to the present invention during their manufacture.

FIG. 4 depicts two options for forming contactor 21 and skirt 23. In one tab-forming line 31, contactor 21 is formed or cut during the lancing stage, when the entire tab blank remains flat. Contactor 21 is bent downwardly with surrounding material to form skirt 23 in the subsequent wipe down stage or station. Alternatively, in tab-forming line 33, contactor 21 and skirt 23 are formed simultaneously in a bending operation in the wipe down stage or station.

Figure 5:
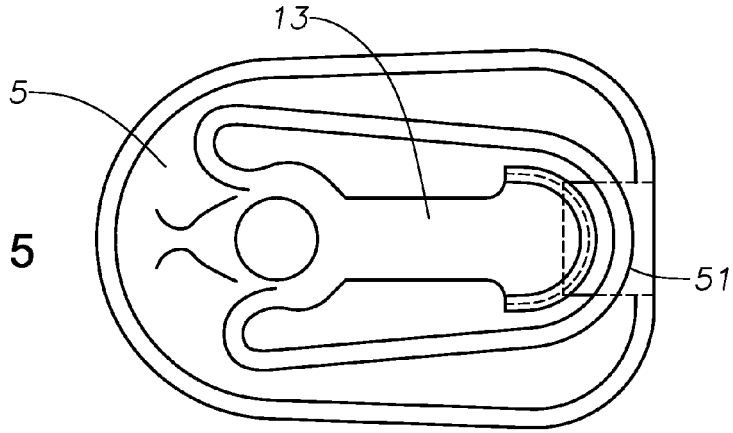
FIG. 5 is a plan view of a tab according to the present invention.

FIG. 5 depicts a shelf 51 carried by tab 5 and underlying the head or end of secondary tab 13. Shelf 51 underlies and provides a protective barrier between secondary tab 13 and vent panel 11 and vent score 35. Shelf 51 prevents secondary tab 13 from opening vent panel 11 and vent score 35 during shipping and handling of the can 1. When tab 5 is lifted upward from lid 3, pour panel 9 is opened and secondary tab 13 is released or disengages from shelf 51 at a lift angle of tab 5 that is dependent upon the length of shelf 51 (a longer shelf 51 requires a higher lift angle and vice-versa). After tab 51 is lifted and secondary tab 13 is released from shelf 51, tab 5 is pushed back down onto lid 3 and shelf 51 will overlie and rest on the top surface of tab 13. As tab 5 is forced against secondary tab 13, the contact surface of shelf 51 forces secondary tab 13 and contactor 21 against the vent score 35 and ultimately fractures it and opens vent panel 11.

Figure 6:
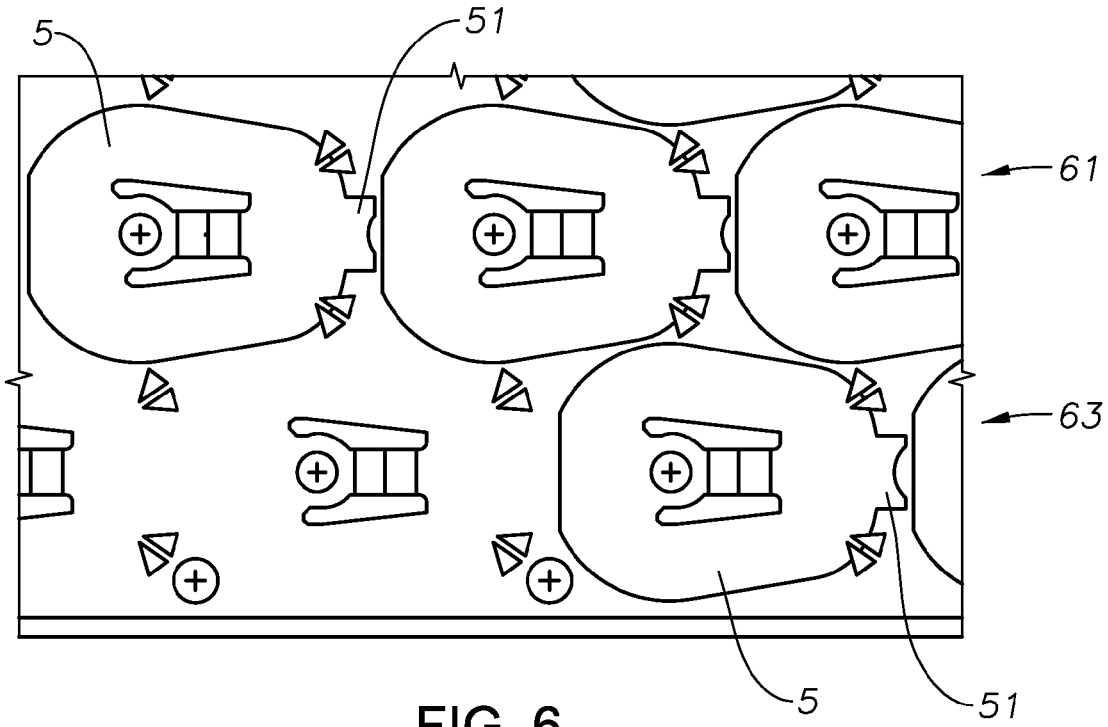
FIG. 6 is a view of tabs according to the present invention during their manufacture.

FIG. 6 illustrates two tab blank lines 61, 63, where the features of tab including shelf 51 is cut or formed. In line 61, shelf 51 has an overall length of 0.125 inch and in line 63, shelf 51 has an overall length of 0.135 inch. The length of shelf 51 is important in that there must enough shelf contact surface on secondary tab 13 to withstand the forces required to open vent score 35. There is a trade-off for shelf length in that a shorter shelf 51 has a lower release angle of secondary tab 13 from main tab 5, but a longer shelf 51 presents a stronger contact surface required to fracture vent score 35 and open vent panel 11.

Figure 7:
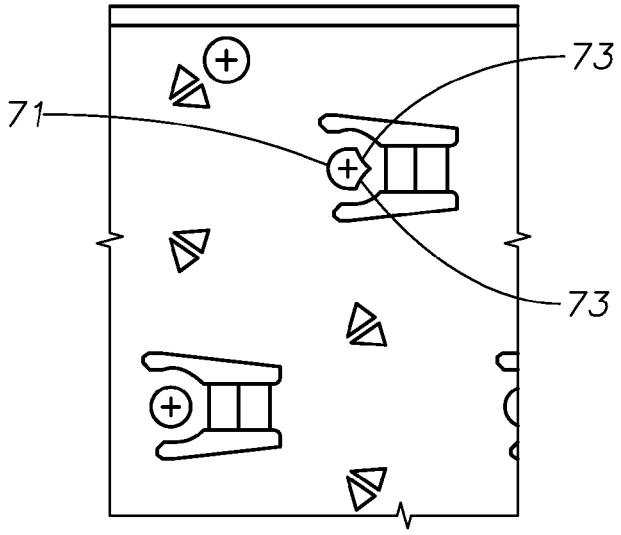
FIG. 7 is a plan view of tabs according to the present invention during their manufacture.

It can be appreciated that rotation of tab 5 about rivet 7 is undesirable because it is important that tab 5 and secondary tab 13 remain aligned with pour panel 9 and its score and vent panel 11 and its vent score 35 for proper opening of the respective pour and vent openings. One method of preventing rotation is to alter the shape of rivet 7 and the corresponding opening in tab 5 to prevent rotation of tab 5. FIG. 7 depicts a scalloped rivet hole 71 that has scalloped edges 73 around the perimeter of the rivet hole. Tab 5 is secured onto lid 3 by inserting the rivet barrel on lid 3 into rivet hole 71 in tab 5. Then the rivet head is formed on top of the tab by upsetting the rivet barrel, which sandwiches tab 5 between the rivet head and lid 3. When the rivet head is formed it causes aluminum from the rivet barrel to flow into the rivet hole scallops, which prevents tab 5 rotating around the rivet barrel.

Figure 8A:
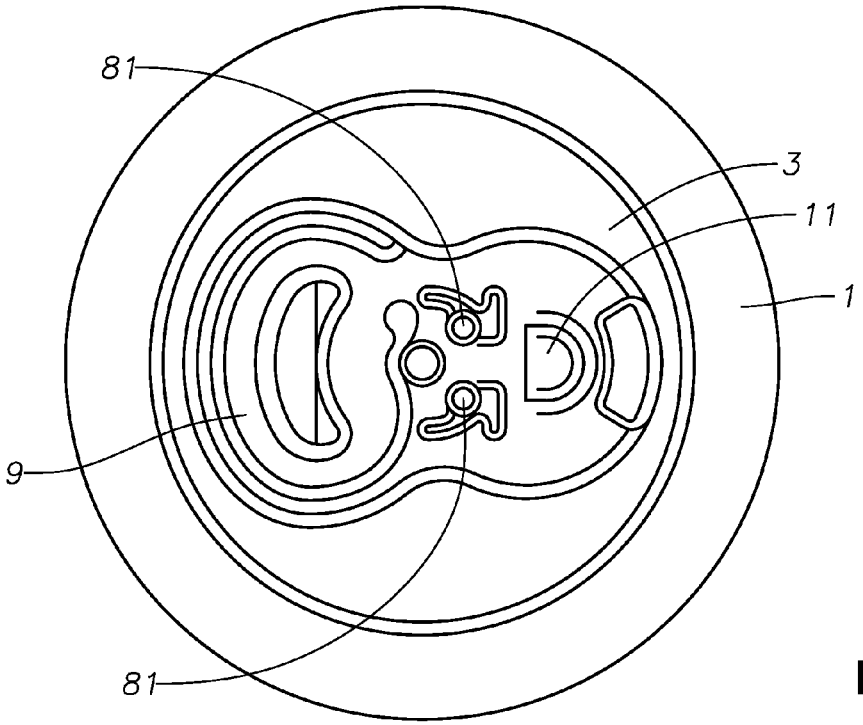
FIGS. 8A and 8B are plan views of an end of a beverage container according to the present invention having a lid and a tab for opening various panels in the lid
Figure 8B:
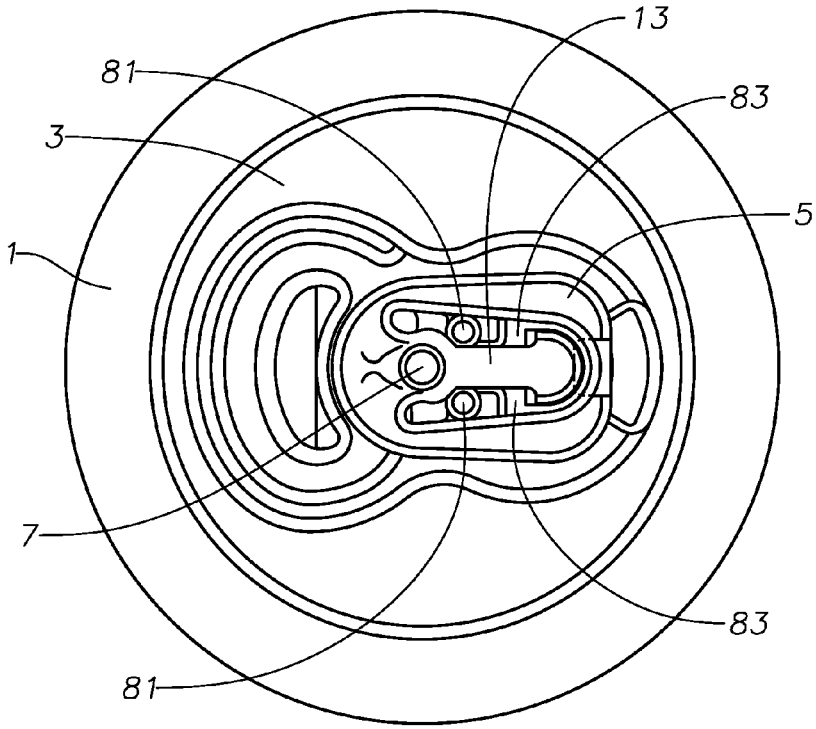

Another method to prevent rotation of tab 5 is illustrated in FIGS. 8A and 8B. In this embodiment, upwardly projecting beads 81 are formed in lid 3 between pour panel 9 and vent panel 11. Beads 81 engage apertures or slots 83 (FIG. 8B) formed as part of tab 5. Beads 81 are placed so that they are on both sides of the strap 13A on the secondary tab. In this case, slots 83 are part of the design of tab 5. In other embodiments, apertures or indentations can be formed in the underside of tab 5 to engage beads 81 and the beads could be formed on the underside of tab 5 with indentations in lid 3.

The shape of the vent score can reduce the force required to open the vent score and vent panel 11 as well as how far vent panel 11 opens. FIGS. 9A through 9E depict various embodiments of a vent score and vent panel. A conventional "D-shaped" score 91 shown in FIG. 9A will not completely fracture and creates a long hinge 93 on the score that causes the vent panel 95 to spring back closed after initial opening. FIGS. 9B through 9E depict vent score configurations with generous radii around short hinges that should fracture more easily and bend downwardly into can 1 with less or no spring back. Other score shapes may be appropriate.

Figure 11:
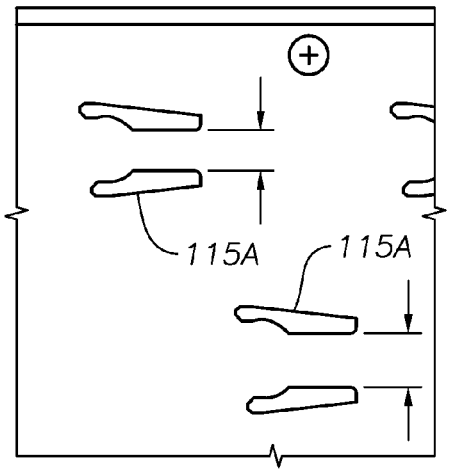
FIG. 11 is a plan view of tabs according to the present invention during their manufacture.

FIGS. 10 and 11 illustrate variations in the width of secondary tab 13 strap 13A, which attaches a head 13B of secondary tab 13 to tab 5 and rivet 7. At first it was thought that the width of the secondary tab was relatively unimportant, but there was some concern that if the width was to narrow there would be difficulty in transferring the material thru the manufacturing process. The width of secondary tab strap 13A in part determines when secondary tab 13 releases from tab 5. A narrower secondary tab strap 13A causes secondary tab 13 to release sooner than a wider tab strap. FIG. 11 shows two tab blanks with different tab widths: Tab 115A has a width of 0.070 inch, while tab 115B has a width of 0.110 inch. An intermediate width is 0.090 inch.

Figure 12B:
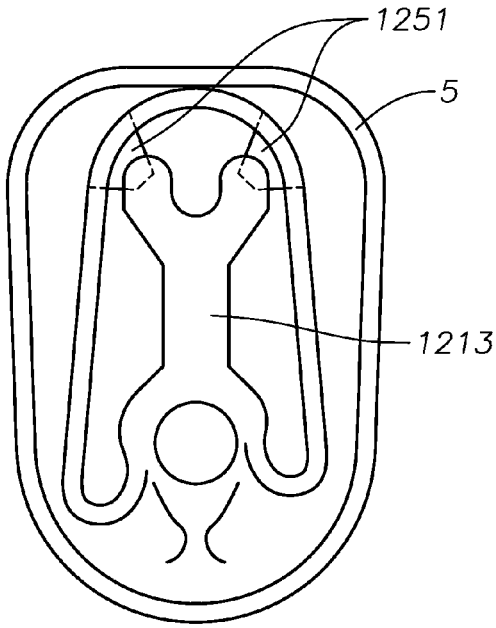
FIGS. 12A through 12C are views of a tab according to the present invention.
Figure 12A:
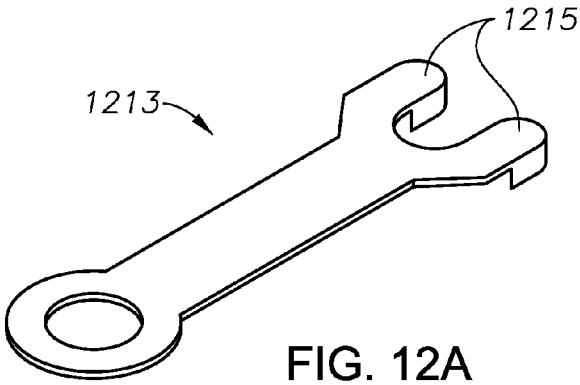
Figure 12C:
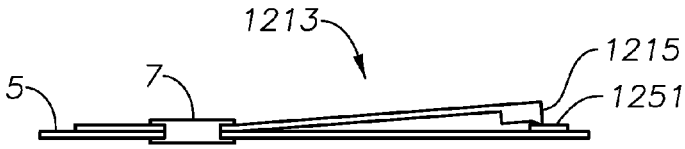

FIGS. 12A through 12C illustrate a "wishbone" or two-prong secondary tab 1213 configuration. In this embodiment, the secondary tab head has been split into two heads 1215 with a space between them. Two separate heads requires two shelves 1251, one for each secondary tab head 1215. This embodiment provides a window for the consumer to view and receive verification that the vent score is fractured and vent panel is open.

Figure 13A:
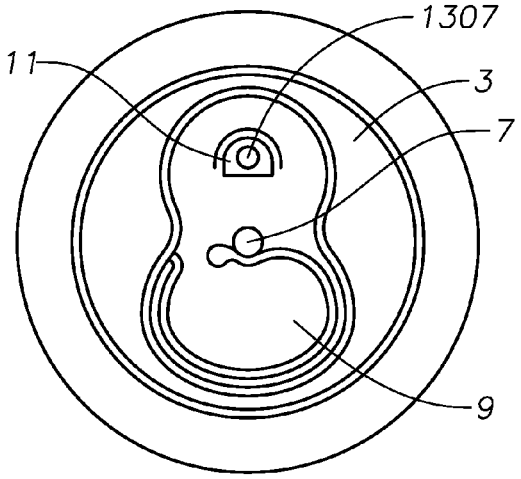
FIGS. 13A-13K are views of a can lid and tabs according to the present invention.
Figure 13B:
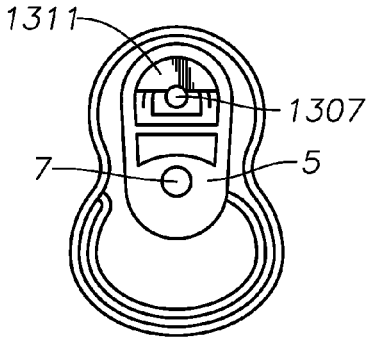
Figure 13C:
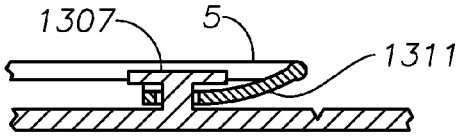
Figure 13D:
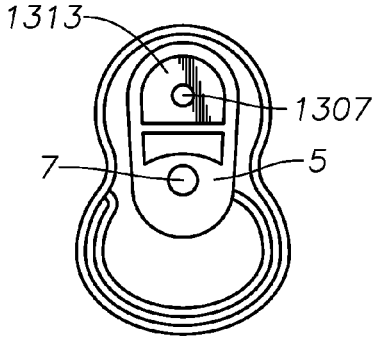
Figure 13F:
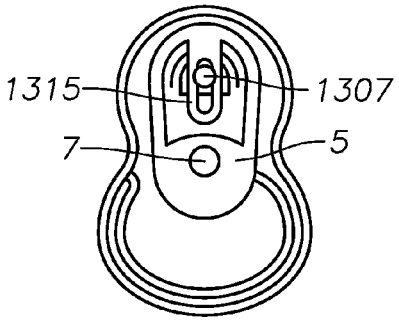
Figure 13E:
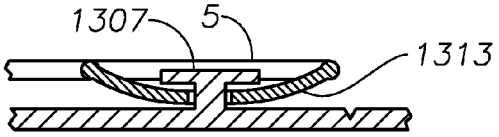
Figure 13G:
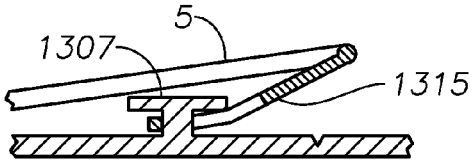
Figure 13H:
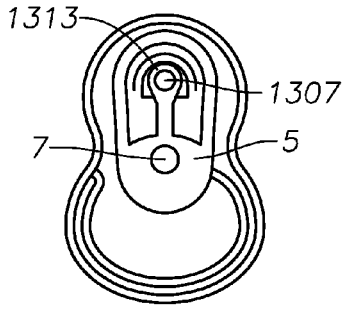
Figure 13I:
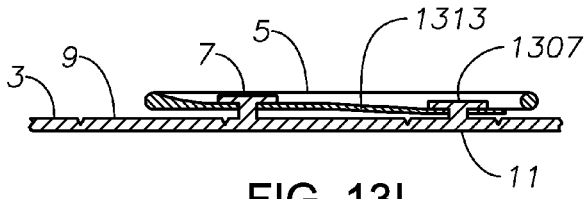
Figure 13J:
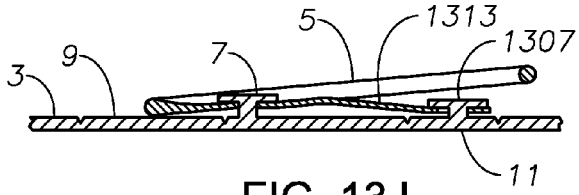

FIGS. 13A through 13K depict several two-rivet embodiments. As shown in FIG. 13A, lid 3 is provided with two rivets, the conventional tab rivet 7, between the pour 9 and vent 11 panels, but also a rivet 1307 on vent panel 11. In this embodiment, vent panel 11 is pulled upward when the tab is lifted (instead of being pushed downward as depicted above). FIGS. 13B and 13C depict an embodiment in which vent panel rivet 1307 is secured to tab by a D-shaped panel in the opening of tab 5 that leaves a portion of tab 5 open. FIGS. 13D and 13E illustrate another embodiment in which vent tab rivet 1307 is secured to tab 5 by a panel 1313 that obscures the entire opening in tab 5. FIGS. 13F and 13G show yet another embodiment in which vent tab 1307 is secured to tab in a slot in an elongate portion 1315 of tab 5. This permits relative movement between tab 5 and vent rivet 1307 to (allows free lift of tab to ease getting finger under tab) smooth the opening of vent panel 11. FIGS. 13H through 13K illustrate an embodiment in which a strap 1313 rigidly connects second rivet 1307 to tab 5. As tab 5 is lifted, it exerts tension on strap 1313, which acts on second rivet 1307 to fracture the vent score and open vent panel 11.

Figure 14A:
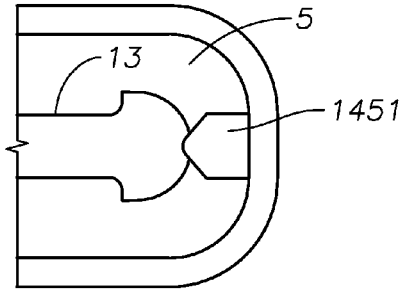
FIGS. 14A through 14E are views of a tab according to the present invention.
Figure 13K:
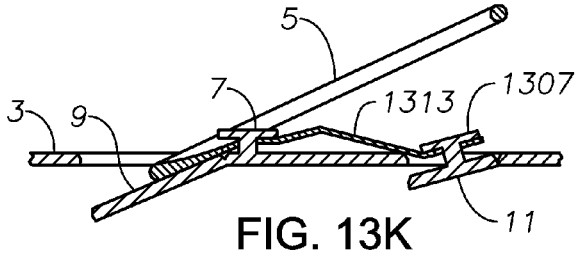
Figure 14B:
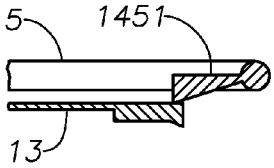
Figure 14C:
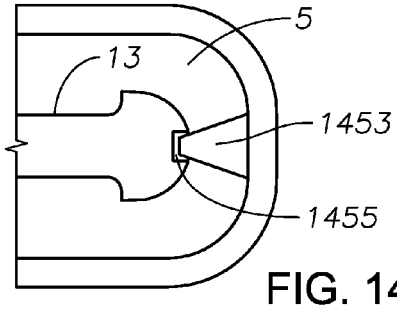
Figure 14D:
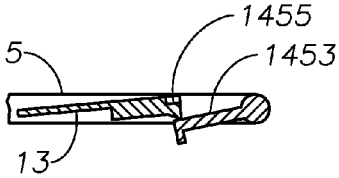
Figure 14E:
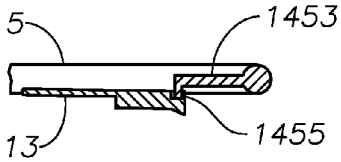

FIGS. 14A through 14E show designs for the shelf that increase its rigidity for pushing secondary tab 13 downward to fracture the vent score and open vent panel 11. In FIGS. 14A and 14B, shelf 1451 is triangular in section (FIG. 14B) with the wider base in contact with secondary tab 13. In FIGS. 14C through D, shelf 1453 has a downwardly turned protrusion that engages a recess 1453 in the upper surface of secondary tab 13 after tab 13 is released from shelf 1453 by upward movement of tab 5. The engagement between the protrusion on shelf 1453 and recess 1455 insures contact between the two as tab 13 is pressed downward into contact with the vent score, thus insuring that downward force is transferred from tab 5 to vent panel 11 and score.

Figure 15:
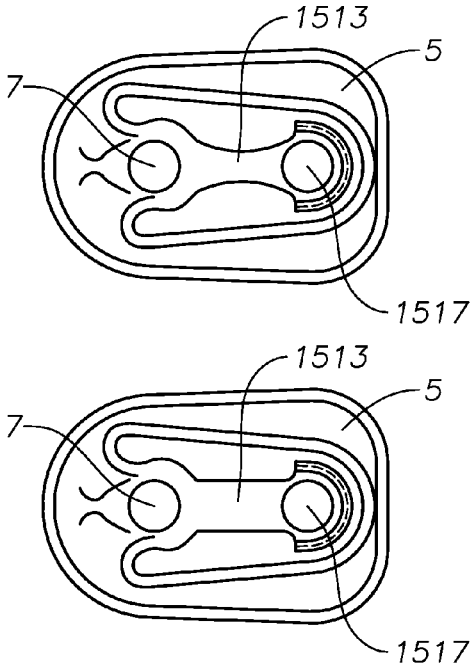
FIG. 15 is a plan view of a pair of tabs according to the present invention.
Figure 16A:
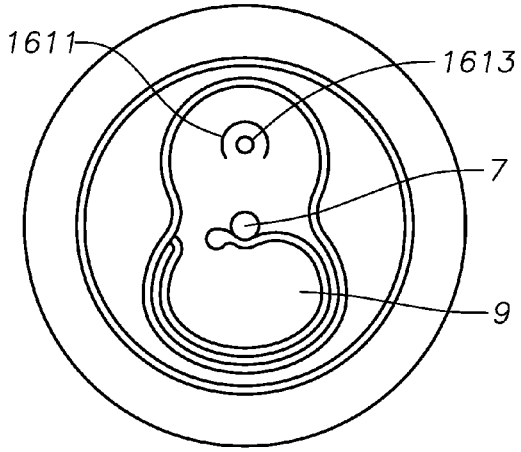
FIGS. 16A through 16E are views of a tab according to the present invention.
Figure 16B:
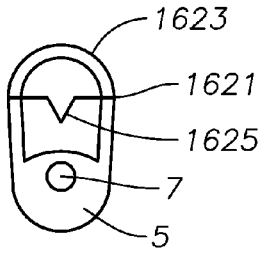
Figure 16D:
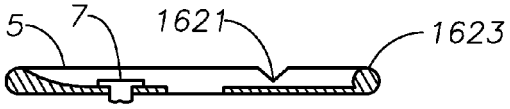
Figure 16E:
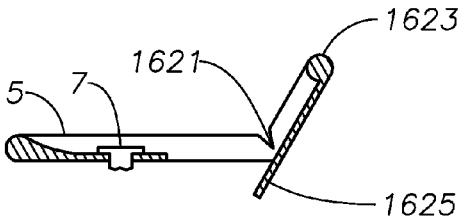
Figure 16C:
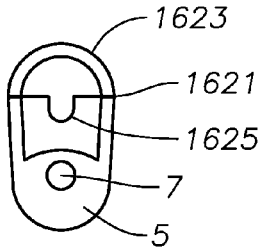

FIG. 15 illustrates two embodiments of a tab 5 having a circular or round window or aperture 1517 formed in the head end of secondary tab 1513. This aperture or window allows a user to see "through" secondary tab 1513 to determine if vent panel 11 is open. In the upper embodiment of FIG. 15, secondary tab 1513 has a narrowed waist section to save on material.

An alternative embodiment allowing a user to determine if vent panel 11 is open, is application of a pressure-sensitive ink or coating on or around vent panel 11, such that pressure applied during opening will change the color of the ink or coating, alerting the user that vent panel 11 is open. Alternatively, a carbon-dioxide-sensitive ink or coating may be used, that changes color when exposed to CO2 from the can contents when vent panel 11 is opened.

FIGS. 16A through 16E show another embodiment for opening vent panel 1611. In this embodiment, tab 5 is hinged 1621 at a location spaced apart from rivet 7. Upon lifting tab 5, hinge 1621 bends and provides a ring 1623 for the user's fingertip. Additionally, the portion of ring 1623 closest to rivet 7 had a piercing tab or contactor 1625, which may be pointed or rounded to contact an indentation 1613 in vent panel 1611 to fracture the score and open it upon pressing tab 5 back down onto lid 3.

Figure 17:
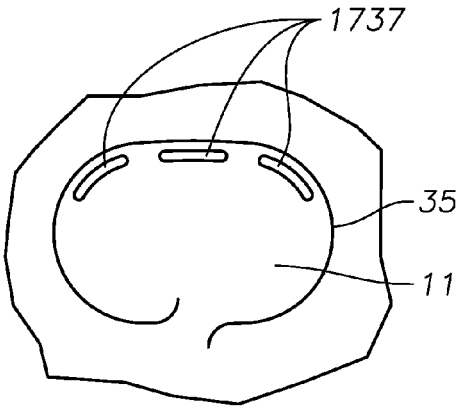
FIG. 17 is a plan view of a vent panel and score according to the present invention.

FIG. 17 illustrates the use of stiffening beads 1737 adjacent vent score 35 of vent panel 11. These beads 1737 provide improved opening performance of vent score 35 by stiffening the area around the vent score 35 with indentations into the surface of lid 3. During formation of stiffening beads 1737, any loose or unstressed metal around vent score 35 will be forced into the stiffening beads, reducing the amount of movement and force that is required to open vent panel 11. Preferably, three beads 1737 are provided adjacent and inward of vent score 35. Beads 1737 have the approximate shape of the portion of vent score 35 to which they are adjacent. Other sizes, numbers, and positions of beads may be appropriate.

Figure 18A:
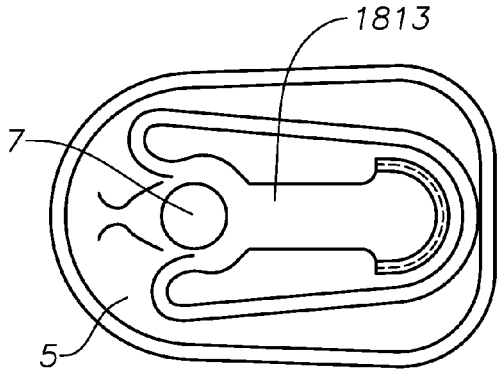
FIGS. 18A and 18B are views of a tab according to the present invention.
Figure 18B:
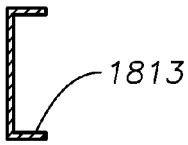

FIGS. 18 A and 18B depict a secondary tab 1813 that is made more rigid by forming it in a c-shaped cross-section (FIG. 18B). A more rigid secondary tab is expected to release more quickly from the shelf of main tab 5 and the consumer has less chance of placing their finger under the secondary tab.

Figure 19:
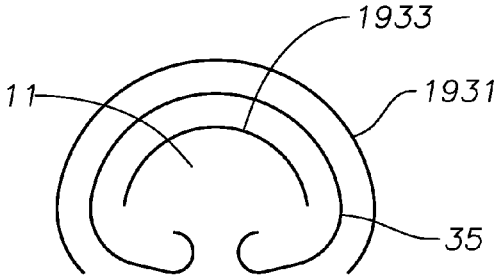
FIG. 19 is a plan view of a vent panel and score according to the present invention.

FIG. 19 illustrates anti-fracture scoring 1931, 1933, which helps eliminate stress when forming the main vent score 35. If stress level is too high during formation of vent score 35, the aluminum may crack. Anti-fracture scoring can also help with improving vent opening performance. Two scores 1931, 1933 on both the inside and outside of vent score 35 are illustrated, but either one may be provided alone.

Figure 20A:
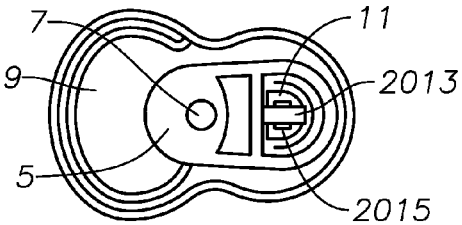
FIGS. 20A and 20B are views of a tab according to the present invention.
Figure 20B:
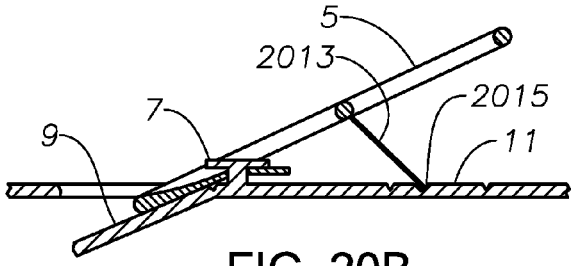

FIGS. 20A and 20B illustrate an embodiment in which the stamped secondary tab is replaced with a spring-loaded "pushrod" 2013. When tab 5 is lifted, pushrod 2013 extends downwardly and catches or engages a recess 2015 formed in vent panel 11. When tab 5 is pushed back down onto lid 3, pushrod 2013 presses on vent panel 11 and fractures the vent score, thus opening panel 11.

Figure 21A:
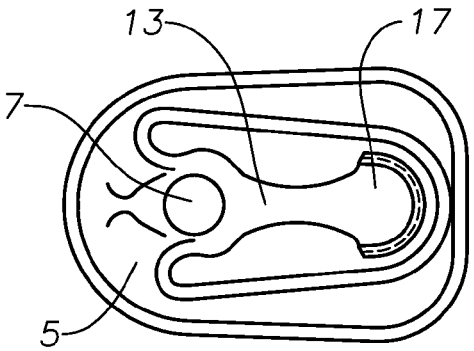
FIGS. 21A and 21B are plan views of a tab according to the present invention.
Figure 21B:
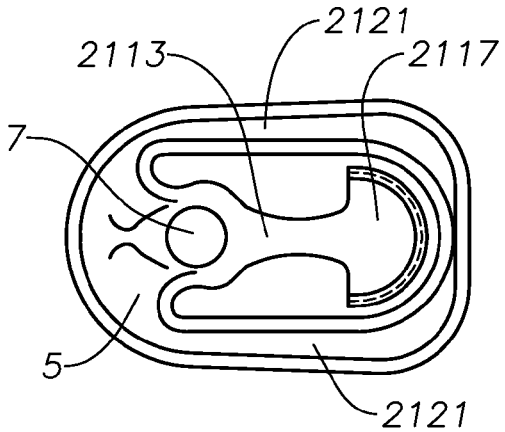

FIGS. 21A and 21B contrast two tabs 5 with the tab of FIG. 21B having an enlarged head 2117 on its secondary tab 2113 compared to the tab of FIG. 21A (which is representative of those previously described). Larger tab head 2116 permits a consumer to push secondary tab head 2117 into the vent panel 11. This will result in an increase in the vent panel opening (pushing it further inside the can). Larger tab head 2116 requires narrower tab legs 2121, which may adversely affect the strength of tab 5.

Figure 22:
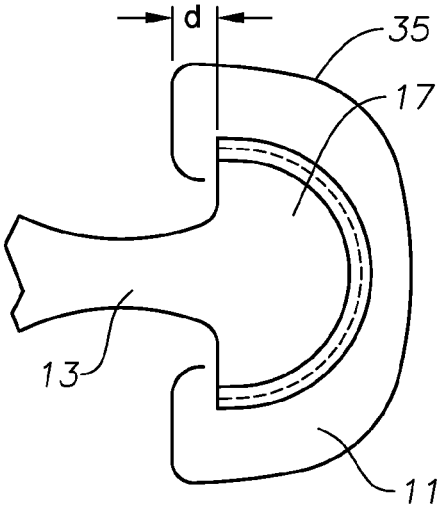
FIG. 22 is an enlarged view of a portion of a tab and a vent panel and score according to the present invention.

FIG. 22 illustrates a distance d between the skirts (see FIG. 2, above) on the secondary tab 13 and the hinge of vent panel 11. Decreasing this distance d changes the position where the skirts make contact with vent score panel 11 and allows the skirts to push vent panel 11 further into the vent score hole.

Figure 23:
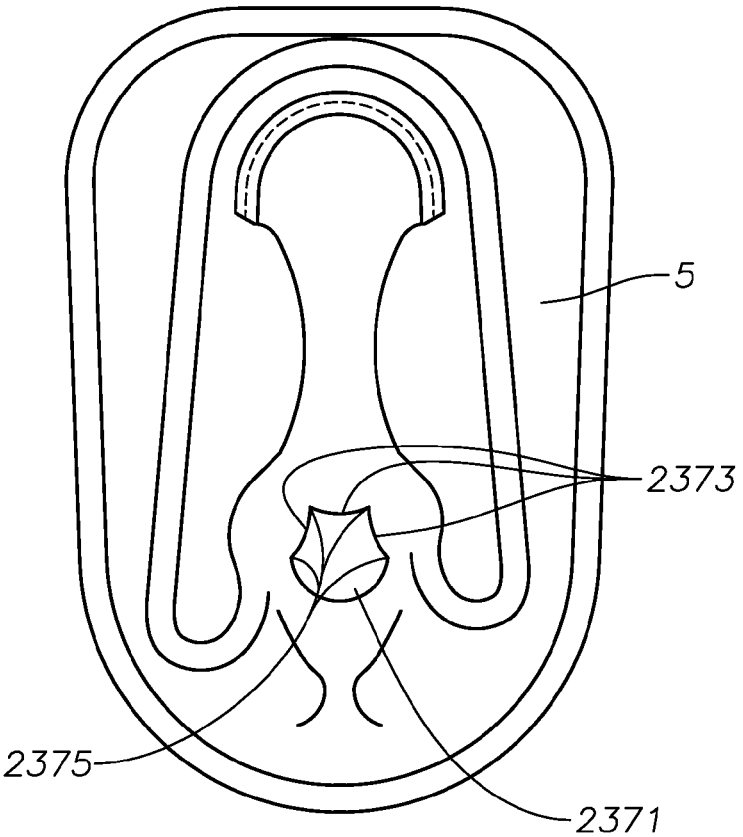
FIG. 23 is an enlarged view of a portion of a tab according to the present invention.

FIG. 23 shows an alternative to the scalloped rivet hole disclosed in connection with FIG. 7, above. In the embodiment of FIG. 7, a pair of scallops 73 or indentations, were formed in rivet hole 71, forming three "peaks," one between the scallops 73 and one on either side. In the embodiment of FIG. 23, three circular scallops 2373 are formed in rivet hole 2171, forming four peaks or points 2375 at approximately 8:00, 10:00, 2:00 and 4:00 positions. It has been discovered that the embodiment of FIG. 7 increases torque required to rotate tab 5 on the rivet 7, but also resulted in increasing the pop force required to open pour panel 9. This embodiment increased the tab-rotation torque without increasing the pop force.

Figure 24:
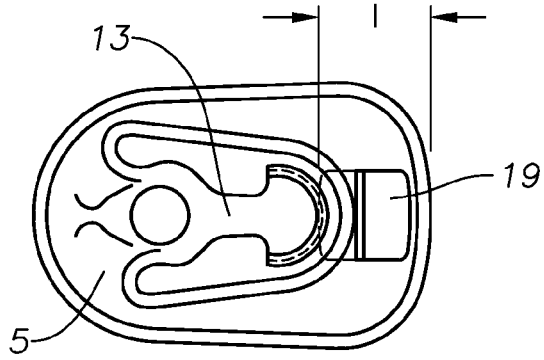
FIGS. 24, 25, and 26 are plan views of tabs according to the present invention.
Figure 25:
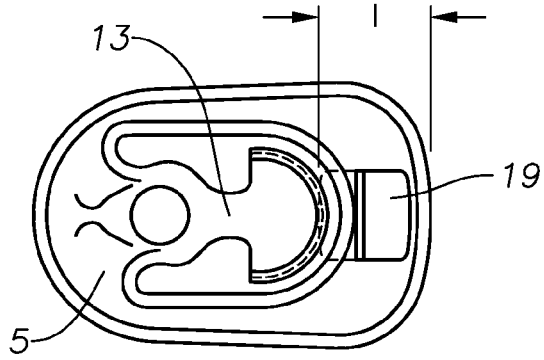
Figure 26:
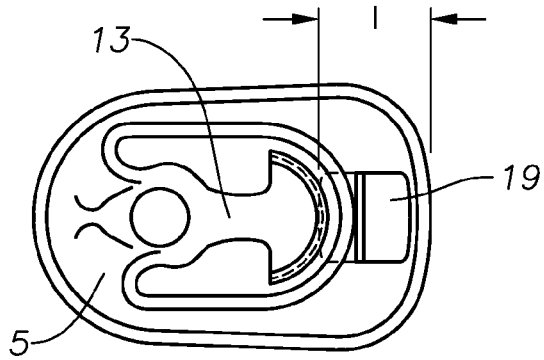

FIGS. 24 through 26 disclose embodiments of a tab in which secondary tab 13 is kept relatively short, increasing the distance 1 between the head of secondary tab 13 and the rear of tab 5. This provides space for a finger hole 19 that permits a user to grasp tab 5 more firmly for actuation and also helps the user avoid finger contact with secondary tab 13. The longer distance 1 also provides a longer lever (of length l) acting on the head of secondary tab 13, which increases the force exerted by secondary tab 13 on vent panel 11. Finger hole 19 is created by using the finger hole metal. Instead of cutting away the metal in finger hole 19, the metal is bent back and used to create the shelf for secondary tab 13.

Figure 27:
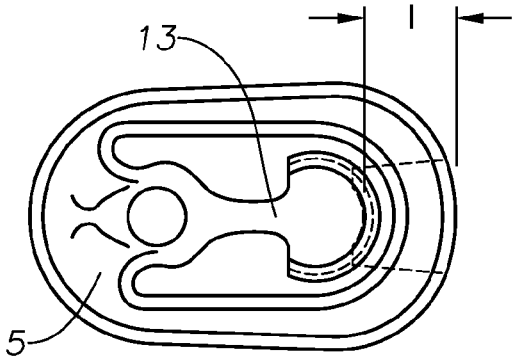
FIGS. 27, 28, and 29 are plan views of tabs according to the present invention.
Figure 28:
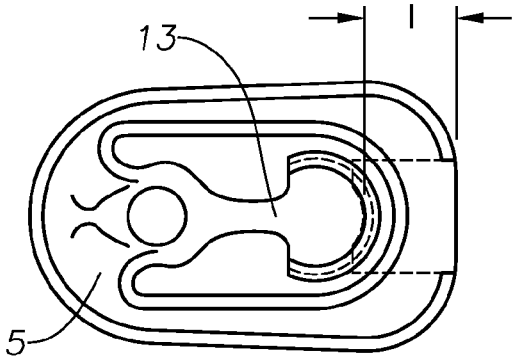
Figure 29:
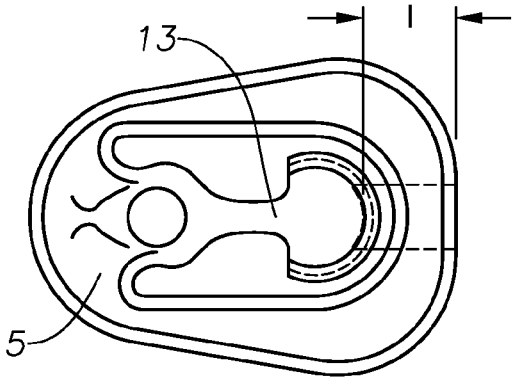

FIGS. 27 and 28 disclose a tab embodiment similar to that of FIGS. 24 through 26, except the length l is increased from 1.15 inch to 1.32 inch. The effects are the same as with the previously disclosed embodiments, only greater because of the increased length l. The embodiments of FIGS. 27 and 28 are similar except that one has a square back and the other round. FIG. 29 shows an embodiment very similar to that of FIG. 28, except tab 5 is 0.7220 inch wide instead of 0.6175 inch. This will improve customer finger access, but at the cost of increased metal usage and different tooling.

Figure 30:
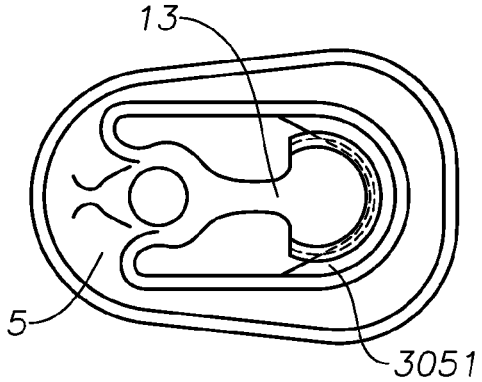
FIGS. 30, 31, and 32 are plan views of tabs according to the present invention.

FIG. 30 illustrates a tab 5 having a shelf 3051 that is most similar to that disclosed by Tamarit Rios. In this case, shelf 3051 encompasses the entire width of the head of secondary tab 13 and is curved to correspond to it. It makes a very rigid shelf that does not flex during opening of vent panel 11.

This design requires that beads or indentations be formed in secondary tab 13 early in the tab-forming process. This shortens tab 13 to avoid interference with shelf 3051. Later in tab-forming, the beads are flattened, which lengthens tab 13 so that it overlies shelf 3051. This method of temporarily shortening the secondary tab can be useful in manufacturing any of the embodiments disclosed herein.

Figure 31:
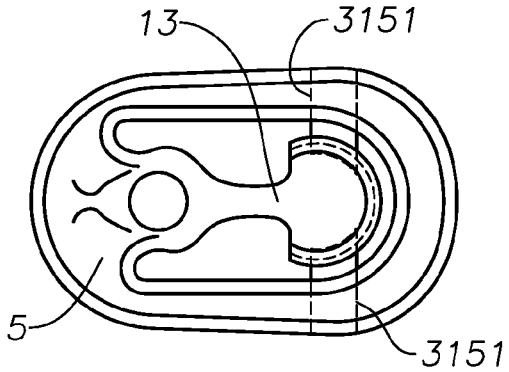

FIG. 31 depicts an embodiment of tab 5 having a pair of side shelves 3151. As opposed to the shelf designs in which the shelf extends from the rear of tab 5, these shelves 3151 extend from the sides of tab 5.

Figure 32:
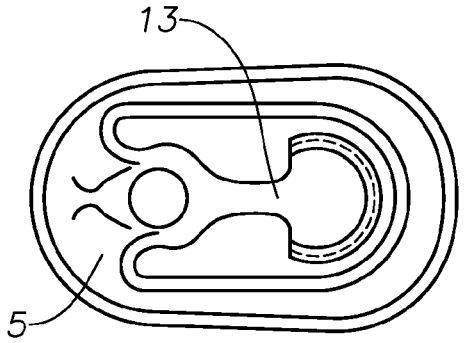

FIG. 32 depicts an embodiment of tab 5 having no shelf at all. This embodiment completely eliminates the possibility of a user sliding his or her finger under secondary tab 13 when lifting tab 5 and also relies entirely upon finger pressure to press secondary tab 13 onto vent panel 11 to open it. It should be noted that any of the secondary tab embodiments are to one degree or another capable of being pressed by a user's finger instead of the tab. However, it may be more difficult to open vent panel 11 without the additional leverage provided by a tab 5 having a shelf. Moreover, because secondary tab 13 is free to contact vent panel 11 at any time, inadvertent opening of vent tab 11 is possible during shipment or storage.

The invention has been described with reference to various embodiments thereof. It is thus not limited, but is susceptible to variation and modification without departing from the scope and spirit of the invention.

I claim:

1. A can lid having a primary opening and a vent opening comprising a can lid top having a score line defining a tear panel, a tab having a rivet hole; the tab connected to the can lid top with a rivet surrounded by the rivet hole;

the rivet having a cross section; the tab comprising a primary tab portion having a front end and a back end; the back end having a shelf;

the shelf having a length and the tab further comprising a secondary tab portion having a fixed end and a free end connected with a beam having a length and a width;

at least a portion of the free end extending over the shelf defining an overlap;

the can lid top having a second score line defining a vent panel, the front end of the primary tab portion positioned to sever the primary score line when the back end of the primary tab portion is lifted and the free end of the secondary tab portion positioned to sever the vent score line after the primary score line has been severed;

the free end of the secondary tab portion positioned above the shelf before the primary score line is severed and below the shelf after the primary score line is severed;

the free end of the secondary tab comprising a puncture point for initially severing the vent score line and a skirt which engages the vent score line after the initial severing the skirt length being shorter adjacent the puncture point and becoming longer distal to the puncture point.

2. A can lid according to claim 1 further comprising a rivet having a non-circular cross section.

3. A can lid according to claim 2 wherein said non-circular cross section is scalloped.

4. A can lid according to claim 2 wherein said non-circular cross section has a major dimension and a minor dimension, said major dimension generally parallel to a line bisecting said tab.

5. A can lid according to claim 2 further comprising at least one feature formed in the can lid top which hinders rotation of the tab around the rivet.

* * * * *